US006695649B1

(12) United States Patent
Ciezak et al.

(10) Patent No.: US 6,695,649 B1
(45) Date of Patent: Feb. 24, 2004

(54) VERTICAL PCB JACK WITH SHIELD

(75) Inventors: Andrew Ciezak, Mokena, IL (US); Satish I. Patel, Elk Grove Village, IL (US)

(73) Assignee: Panduit Corp, Tinley Park, IL (US)

( * ) Notice: Subject to any disclaimer, the term of this patent is extended or adjusted under 35 U.S.C. 154(b) by 0 days.

(21) Appl. No.: 10/212,301

(22) Filed: Aug. 5, 2002

(51) Int. Cl.[7] ..... H01R 23/02
(52) U.S. Cl. ..... 439/676; 439/941
(58) Field of Search ..... 439/676, 941, 439/606

(56) References Cited

U.S. PATENT DOCUMENTS

| | | | | |
|---|---|---|---|---|
| 3,789,505 | A | | 2/1974 | Huntt |
| 4,215,910 | A | | 8/1980 | Walter |
| 4,232,929 | A | | 11/1980 | Zobawa |
| 5,035,632 | A | | 7/1991 | Rudoy et al. |
| 5,160,273 | A | | 11/1992 | Carney |
| 5,205,762 | A | | 4/1993 | Carney |
| 5,328,380 | A | | 7/1994 | Carney |
| 5,387,111 | A | | 2/1995 | DeSantis et al. |
| D359,475 | S | | 6/1995 | Coffey |
| 5,519,578 | A | | 5/1996 | Fujii |
| 5,531,612 | A | | 7/1996 | Goodall et al. |
| 5,564,949 | A | | 10/1996 | Wellinsky |
| 5,597,326 | A | | 1/1997 | DeLessert et al. |
| 5,599,206 | A | | 2/1997 | Slack et al. |
| 5,605,469 | A | | 2/1997 | Wellinsky et al. |
| 5,632,648 | A | | 5/1997 | Liu |
| 5,639,261 | A | | 6/1997 | Rutkowski et al. |
| 5,700,167 | A | | 12/1997 | Pharney et al. |
| 5,836,786 | A | | 11/1998 | Pepe |
| D402,261 | S | | 12/1998 | Carlson, Jr. et al. |
| 5,898,129 | A | | 4/1999 | Ott et al. |
| D411,514 | S | | 6/1999 | Tulley |
| 6,053,764 | A | | 4/2000 | Curry et al. |
| 6,053,778 | A | | 4/2000 | Ivan et al. |
| 6,120,329 | A | * | 9/2000 | Steinman ..... 439/676 |
| 6,186,834 | B1 | * | 2/2001 | Arnett et al. ..... 439/676 |
| 6,332,810 | B1 | * | 12/2001 | Bareel ..... 439/676 |

* cited by examiner

*Primary Examiner*—Neil Abrams
*Assistant Examiner*—Phuong Dinh
(74) *Attorney, Agent, or Firm*—Robert A. McCann; Jay A. Saltzman; Christopher S. Clancy

(57) ABSTRACT

A jack in a telecommunications system for receiving a plug therein, the jack including a housing having an aperture for receiving the plug, a sled having a mating side and a non-mating side, the mating side generally disposed to be accessible from the aperture by the plug, a first plurality of contacts wrapped around the sled so as to extend from the non-mating side of the sled to the mating side of the sled, the first plurality of contacts being accessible by the plug on the mating side of the sled when the plug is inserted into the aperture, a second plurality of contacts wrapped around the sled so as to extend from the non-mating side of the sled to the mating side of the sled, the second plurality of contacts being accessible by the plug on the mating side of the sled when the plug is inserted into the aperture, and a shield disposed generally between the first plurality of contacts and the second plurality of contacts on the non-mating side of the sled.

21 Claims, 9 Drawing Sheets

VERTICAL PCB JACK WITH SHIELD

BACKGROUND OF THE INVENTION

Keeping up with consumer demand, the telecommunications industry continues to design and build increasingly more efficient systems for handling volumes of data. The improved efficiency is manifested, among other ways, increasingly more rigorous standards being established pertaining to the connective apparatus associated with such systems. For example, in order to qualify as Category 6 compliant, connective hardware such as plugs and jacks must meet more rigorous requirements relating to inductance, capacitance, and crosstalk than they must for mere Category 5 compliance. As such, there is a need for more efficient connectors.

SUMMARY OF THE INVENTION

The present invention contemplates non-straight configurations for particular contacts within a telecommunication connector and/or the presence of a floating shield between particular contacts or particular groups of contacts within such a connector to achieve enhanced electrical properties for the connector.

In one embodiment of the invention, there is provided a jack in a telecommunications system for receiving a plug therein, the jack including a housing having an aperture for receiving the plug, a sled having a mating side and a non-mating side, the mating side generally disposed to be accessible from the aperture by the plug, a first plurality of contacts wrapped around the sled so as to extend from the non-mating side of the sled to the mating side of the sled, the first plurality of contacts being accessible by the plug on the mating side of the sled when the plug is inserted into the aperture, a second plurality of contacts wrapped around the sled so as to extend from the non-mating side of the sled to the mating side of the sled, the second plurality of contacts being accessible by the plug on the mating side of the sled when the plug is inserted into the aperture, and a floating shield disposed generally between the first plurality of contacts and the second plurality of contacts on the non-mating side of the sled.

In another embodiment of the invention, there is provided a jack in a telecommunications system for receiving a plug therein, the jack including a housing having an aperture for receiving the plug, a sled having a mating side and a non-mating side, the mating side generally disposed to be accessible from the aperture by the plug, a first plurality of contacts wrapped around the sled so as to extend from the non-mating side of the sled to the mating side of the sled, wherein the first plurality of contacts are accessible by the plug on the mating side of the sled when the plug is inserted into the aperture and wherein the first plurality of contacts generally are disposed in a first common plane on the non-mating side of the sled, a second plurality of contacts wrapped around the sled so as to extend from the non-mating side of the sled to t he mating side of the sled, wherein the second plurality of contacts are accessible by the plug on the mating side of the sled when the plug is inserted into the aperture and wherein the second plurality of contacts generally are disposed in a second common plane on the non-mating side of the sled, the second common plane being distinct from the first common plane of the first plurality of contacts, and wherein at least one of the contacts from the first plurality contacts includes an intermediate portion on the non-mating side of the sled wherein the intermediate portion is bent substantially out of the first common plane in the direction of at least one of the second plurality of contacts to enhance the electrical performance of the jack.

In yet another embodiment of the invention, there is provided a telecommunications system having a plurality of jacks for receiving plugs therein, each of the jacks including a housing having an aperture for receiving one of the plugs, a sled having a mating side and a non-mating side, the mating side generally disposed to be accessible from the aperture by one of the plugs, a first plurality of contacts wrapped around the sled so as to extend from the non-mating side of the sled to the mating side of the sled, the first plurality of contacts being accessible by one of the plugs on the mating side of the sled when the plug is inserted into the aperture, a second plurality of contacts wrapped around the sled so as to extend from the non-mating side of the sled to the mating side of the sled, the second plurality of contacts being accessible by one of the plugs on the mating side of the sled when the plug is inserted into the aperture, and a floating shield generally disposed between the first plurality of contacts and the second plurality of contacts on the non-mating side of the sled.

BRIEF DESCRIPTION OF THE FIGURES

FIG. 1 shows, in perspective view, the general alignment of the plug and the housing prior to insertion of the plug, in a preferred embodiment of the invention. FIG. 2 shows a partial sectional view of the aligned plug and housing just prior to insertion of the plug into the housing cavity. FIG. 3, also in partial section, shows the plug fully inserted into the housing cavity. FIG. 4 shows a sectional view of the housing with the plug inserted therein, taken along the line 4—4 in FIG. 3.

FIGS. 5–7 and 9 primarily show the non-mating (or compensating) side of the sled, while FIG. 8 primarily shows the mating side of the sled.

FIG. 10 shows, in perspective view, the top and bottom rows of contacts separately. FIG. 11 shows the relative positions of all the contacts together, and FIG. 12 shows a side elevational view of the same contacts. FIG. 13 shows a cross-sectional view of the intermediate portions of the contacts of FIGS. 11 and 12, taken across the line 13—13 in FIG. 12.

DETAILED DESCRIPTION OF THE INVENTION

Figure 1:
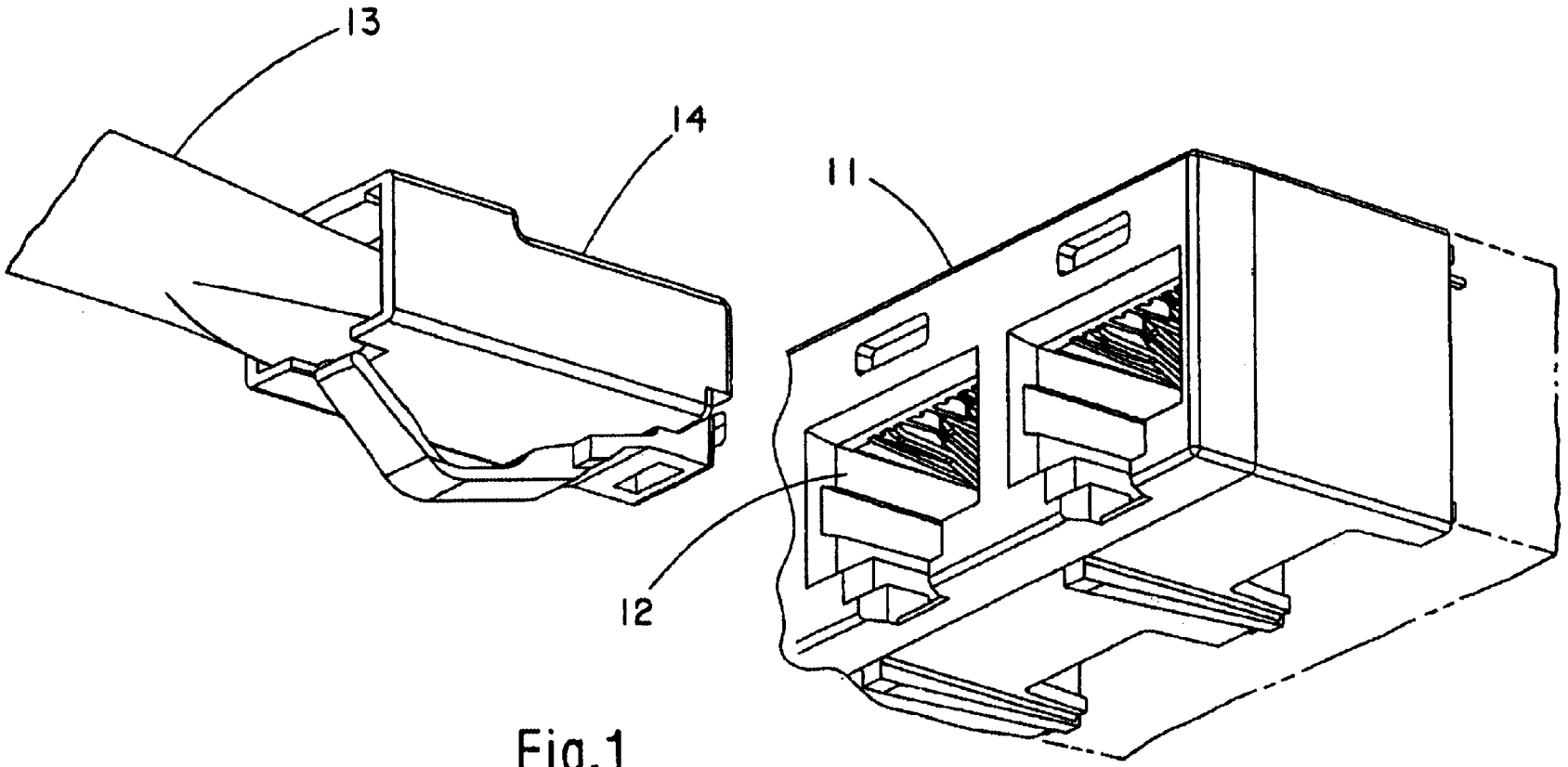
FIGS. 1–4 show the general environment of use of the present invention, wherein a plug at the end of a patch cord is aligned with and inserted into a cavity or aperture defined by a Housing within a patch panel, thereby causing mechanical and electrical contact between electrical contacts on the plug and those protruding from a jack into the housing cavity.
Figure 2:
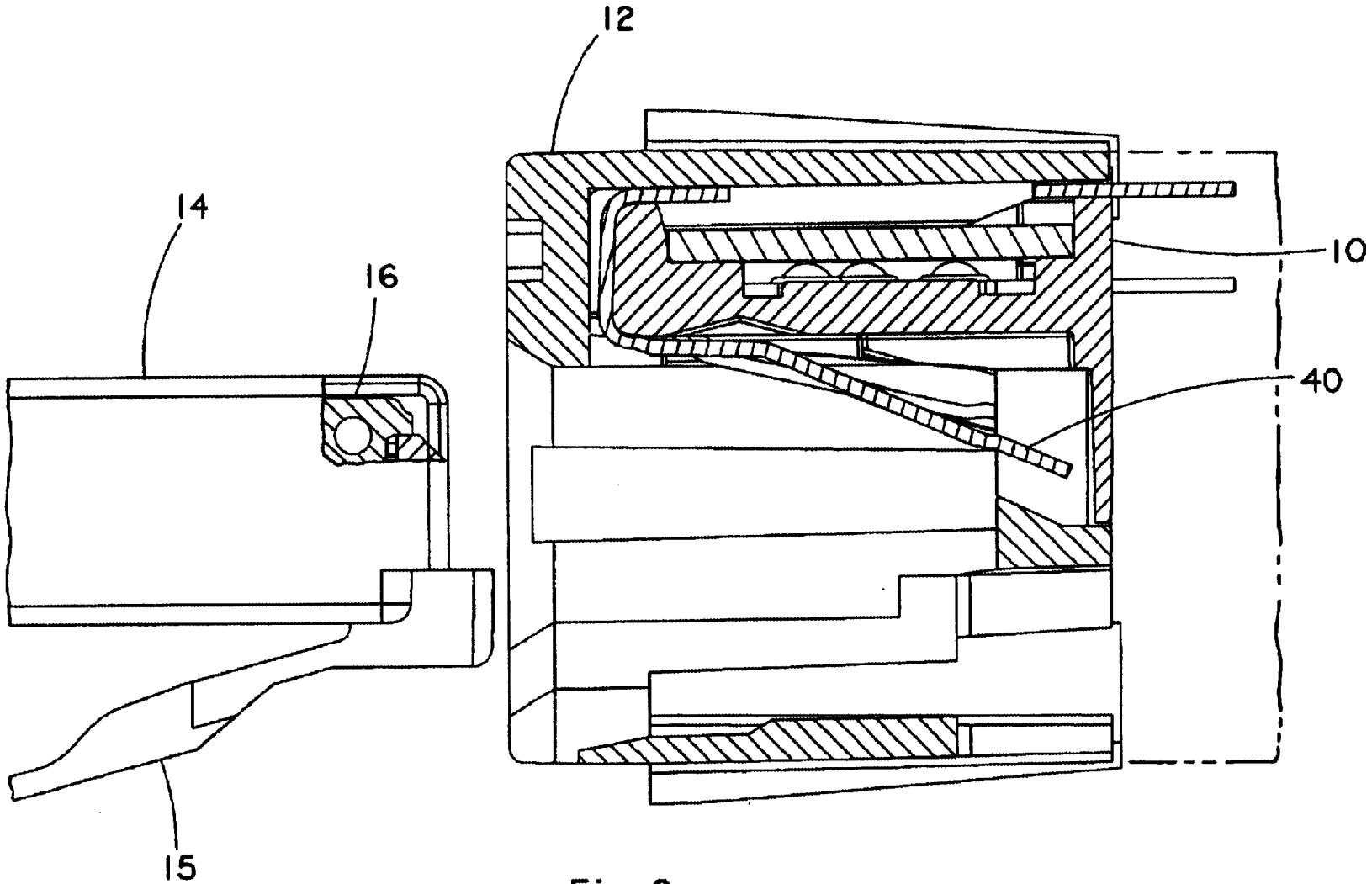
Figure 3:
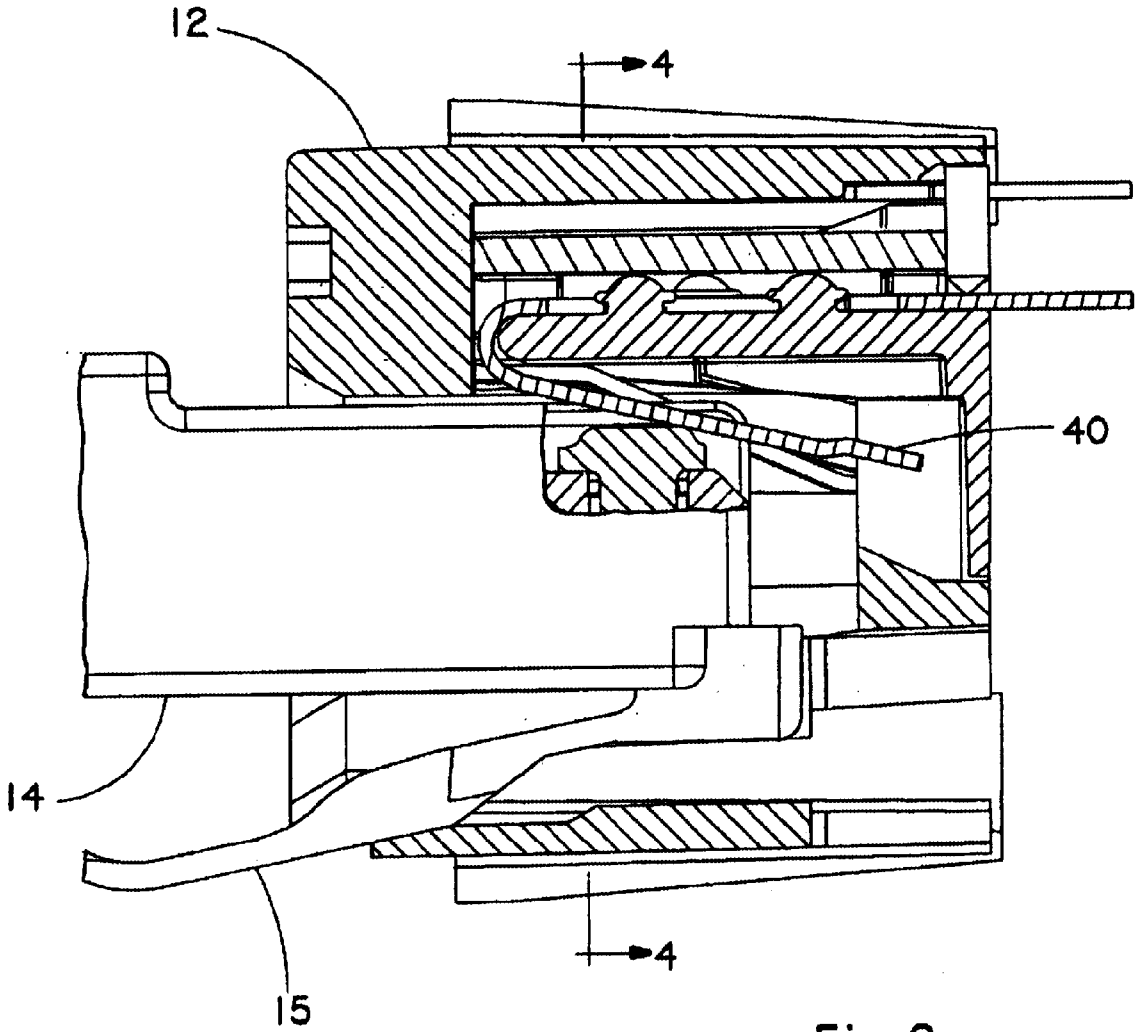
Figure 4:
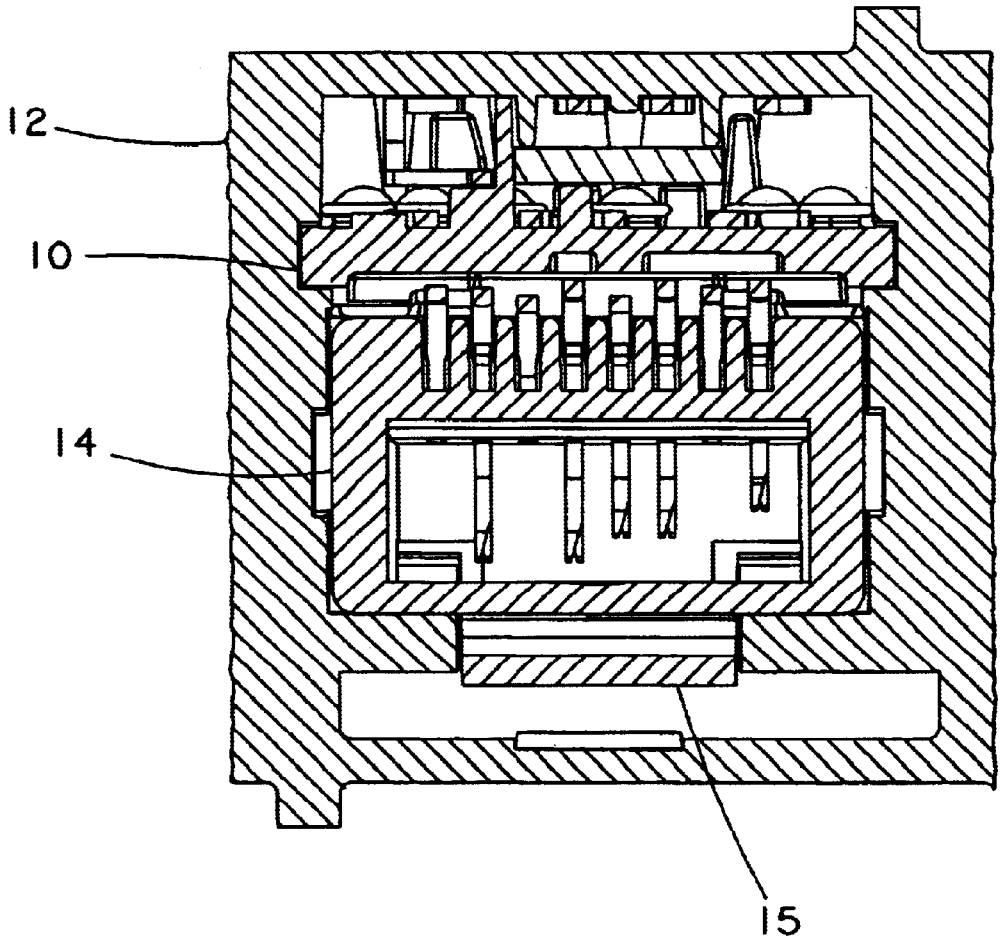
Figure 5:
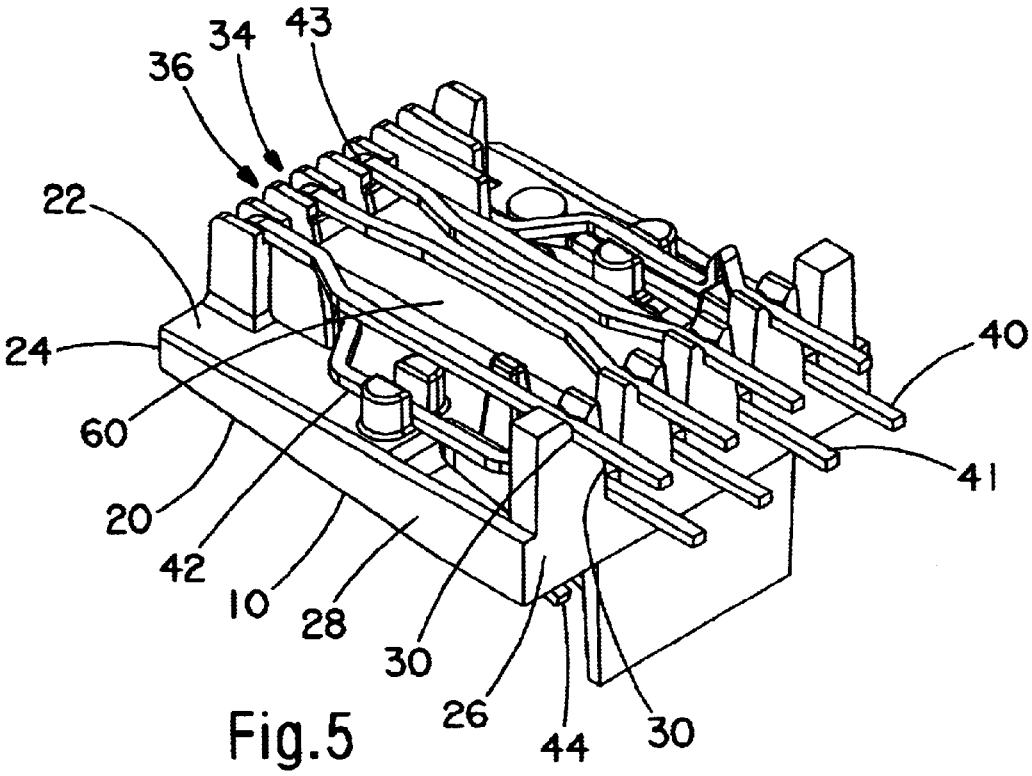
FIGS. 5–9 show, in various perspective views, a sled in accordance with a preferred embodiment of the invention with contacts installed thereon.
Figure 6:
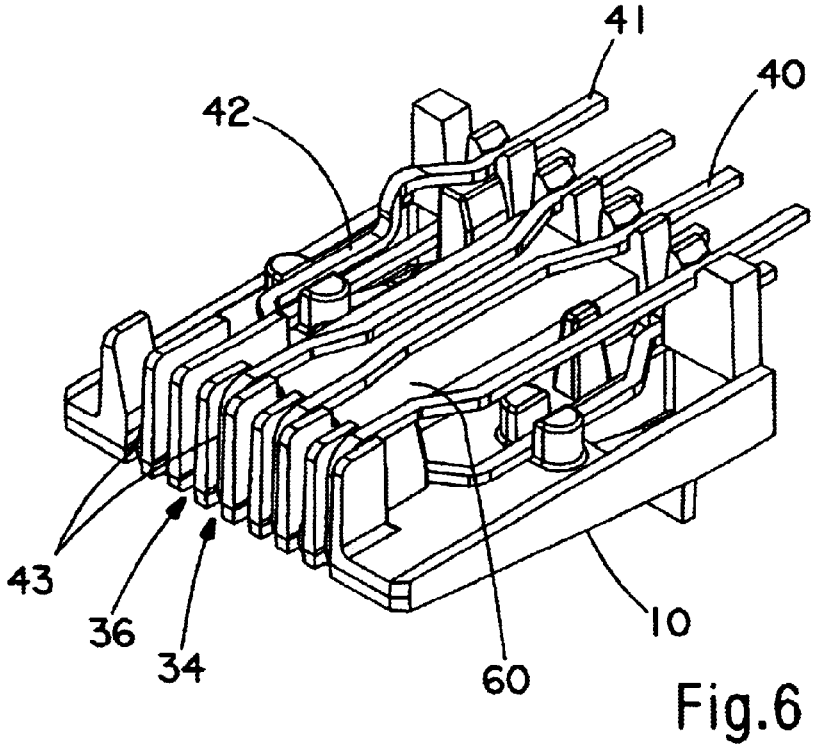
Figure 7:
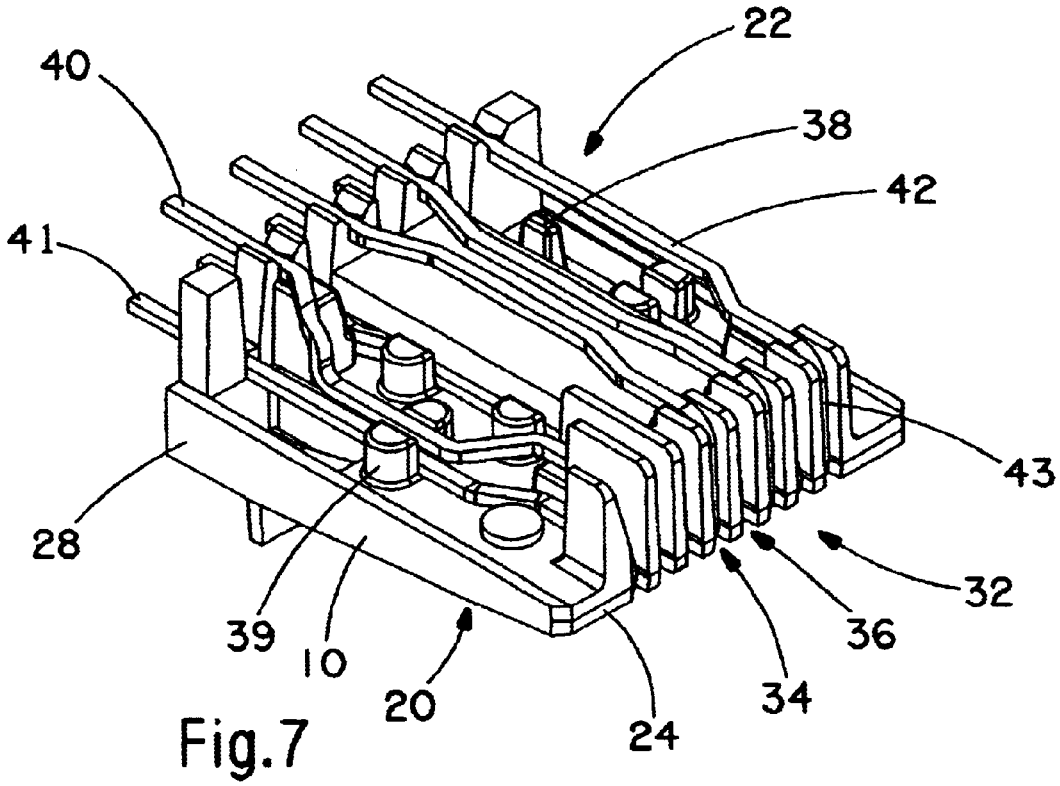
Figure 8:
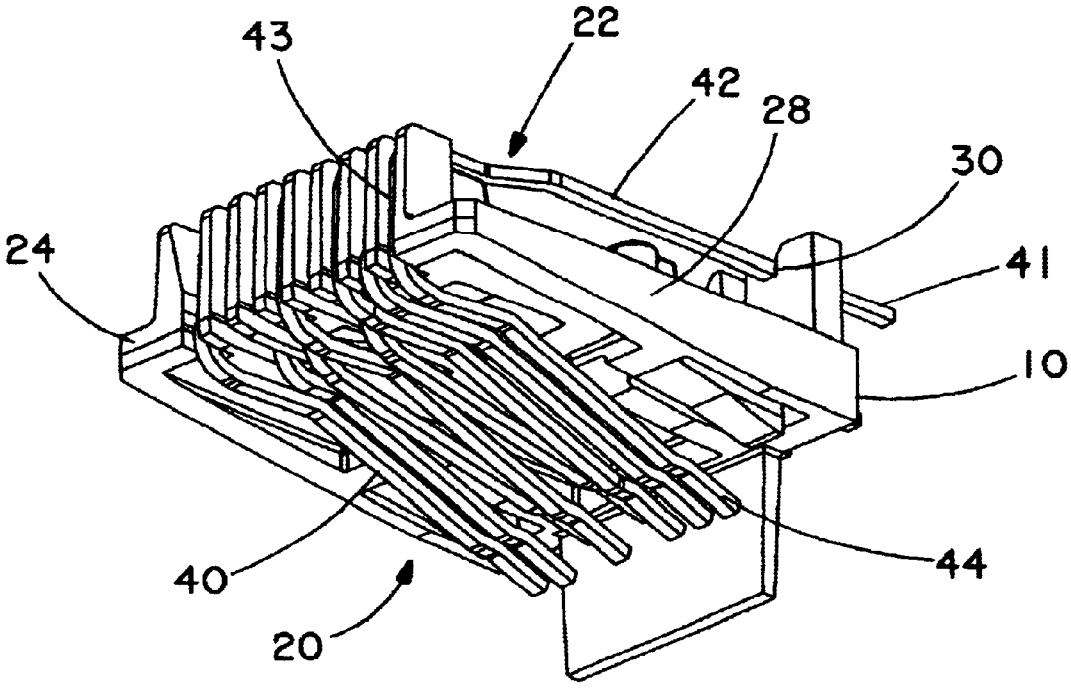
Figure 9:
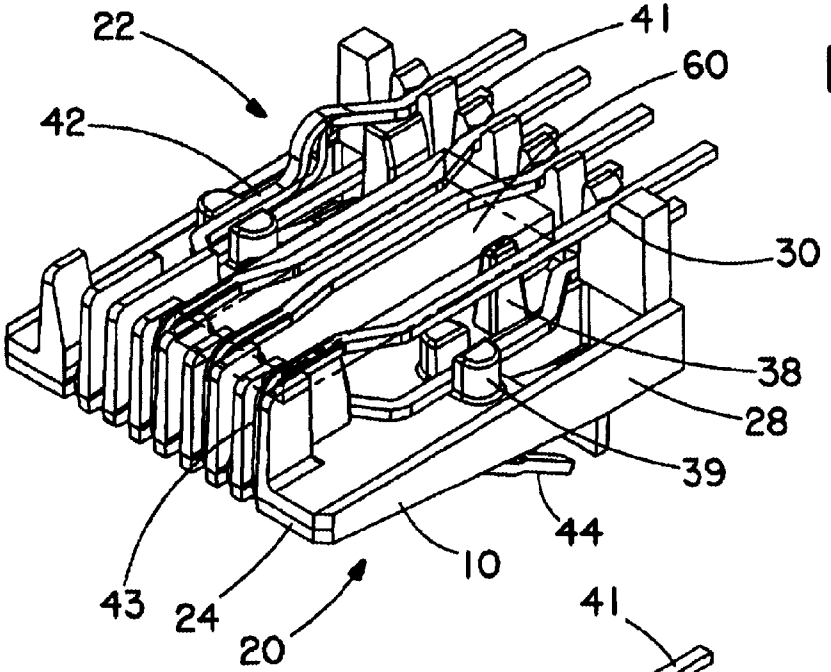
Figure 10:
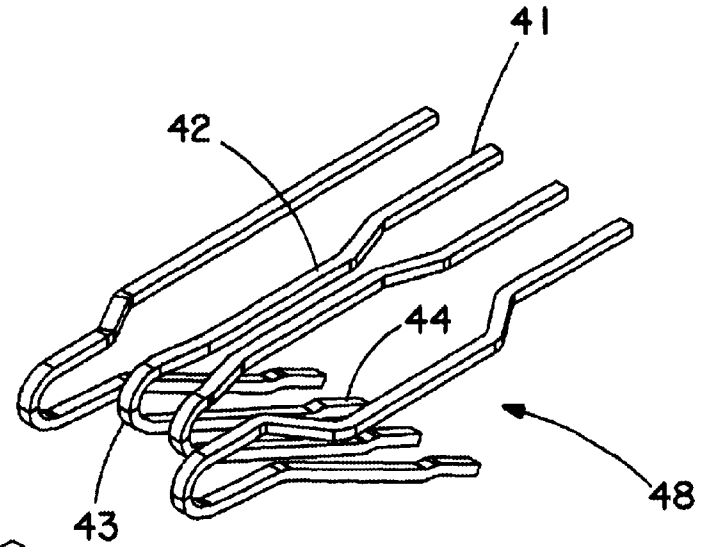
FIGS. 10–13 show the arrangement of contacts according to a preferred embodiment of the invention in their relative position to each other and to the sled. In particular.
Figure 10:
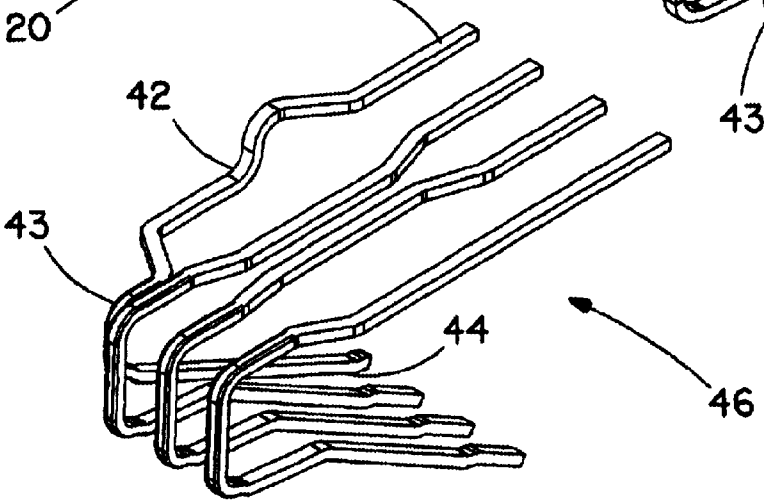
Figure 11:
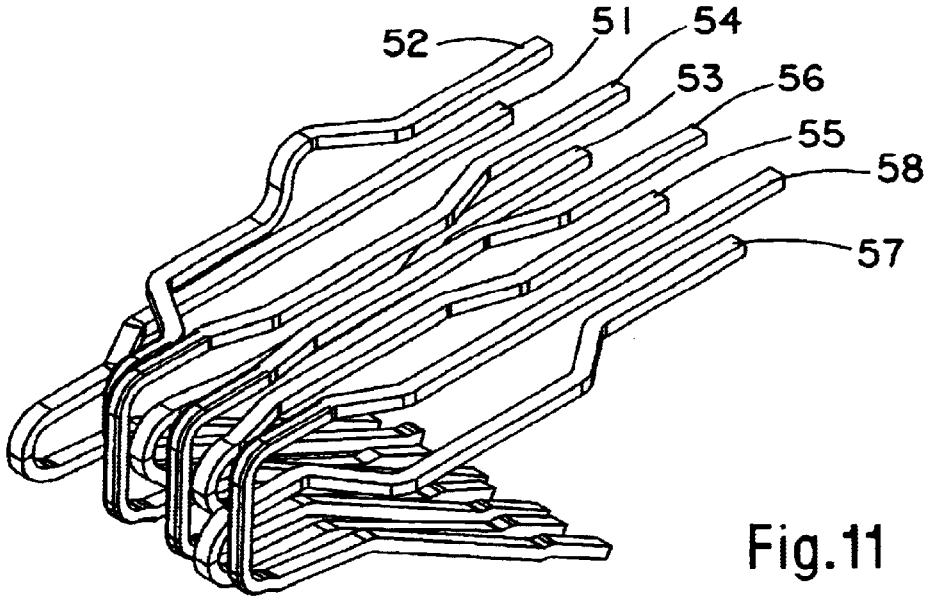
Figure 12:
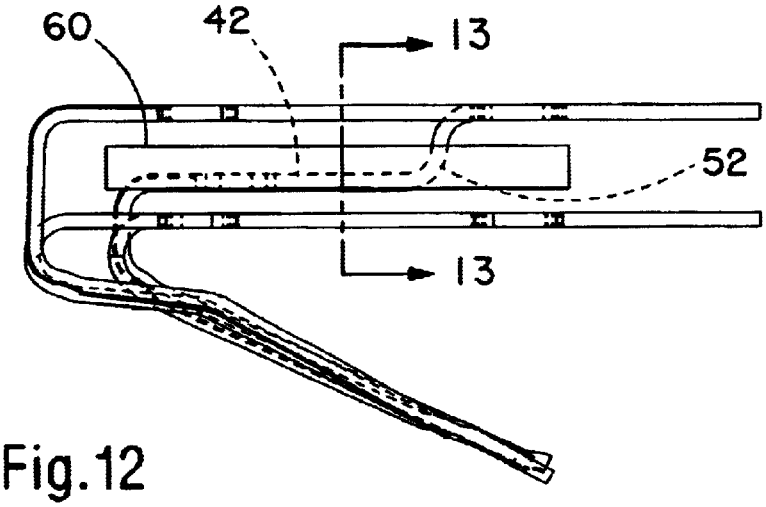

The invention relates to a jack in a telecommunication system. Though the jack is primarily contemplated to be used in a vertical orientation, the orientation is not considered pertinent to the invention, and the disclosed structure may be used in any desired orientation. The disclosed jack has improved electrical properties due to the configuration and orientation of contacts on the sled, due to the presence of a floating shield, and due to symbiotic interactions between the specially configured and oriented contacts and the shield. The enhanced electrical properties permit the more efficient handling of large volumes of data being transmitted through the telecommunications system, more throughput and less signal degradation.

As seen in FIGS. 1–4, the telecommunication system includes a jack having a sled 10 carried within a housing 12 for receiving an appropriately configured plug 14 such that electrical connection is achieved by plug contacts 16 on the plug engaging corresponding contacts 40 on the sled. The contacts 16 on the plug are in electrical communication with a patch cord 13 or the like while the contacts 40 of the sled 10 may be mounted to a printed circuit board (not shown), for example. The plug 14 may include a latch 15 for cooperatively engaging structure on the housing 12 to retain the inserted plug within the cavity.

As seen in FIGS. 5–9, and with reference to FIGS. 1–4, the sled 10 has a mating side 20 that is generally exposed to the cavity of the housing 12 and a non-mating side 22 that is protected within the housing and is not generally accessible from the cavity of the housing. The sled 10 has a front end 24 disposed closer to the opening of the housing and a rear end 26 more remote from the opening of the housing. In a preferred Embodiment, the rear end 26 is also disposed more proximately to a backplane-type printed circuit board. The sled also has a pair of opposed sidewalls 28.

Although the sled may include any number of contacts 40, wrapped thereabout, in the preferred embodiment, there are eight such contacts, four in a top row 46 on the non-mating side 22 of the sled and four in a bottom row 48 on the non-mating side 22 of the sled.

The sled 10 includes wrap-around grooves 32 at its front end 24 so that the contacts 40 may be smoothly wrapped around from the non-mating side 22 to the mating side 20 of the sled. The contacts 40 are also held in place near the rear end 26 of the sled by tail grooves 30, also preferably stratified into two corresponding rows to match the two rows of contacts 46 and 48. This permits the contact tails in the described embodiment to be generally staggered in a manner that minimizes electrical interference between adjacent contacts in the tail portions thereof. The tails may have a through, hole or surface mount contact with a backplane printed circuit board, for example, at their ends.

The wrap-around grooves 32 are also generally stratified into two levels, with some contacts wrapping around the front wrap-around grooves 34 and other contacts wrapping around the rear wrap-around grooves 36. This stratification has the similar effect of increasing contact-to-contact distances and thereby minimizing electrical interferences between adjacent or nearby pairs of contacts in the wrap-around portions of the contacts.

The sled 10 may also preferably include shield-guiding structures 38 used for guiding the shield into its proper position during assembly of the jack. These structures may also help retain the shield on the sled. Similarly, the sled may preferably include some contact-aligning structures 39 on the non-mating side 22 of the sled.

The contacts 40 generally include tail portions 41 for fitting into respective tail grooves 30 on the non-mating side 22 of the sled. The contacts 40 also include wrap-around portions 43 corresponding to the wrap-around grooves 32 of the sled. In between the tail and wrap-around portions, the contacts 40 include intermediate portions 42 that may or may not interact with any contact-aligning structures 39 of the sled. Finally, the contacts 40 include an extension portion 44 cantilevered off the wrap-around grooves over the mating side 20 of the sled. The extension portions 44 generally protrude into the plug-receiving cavity of the housing in such a manner so as to permit corresponding contacts 16 on the plug to openly engage the extension portions 44 upon insertion of the plug into the housing. Preferably, the manner in which the extension portions 44 are resiliently cantilevered off the wrap-around groove 32 will provide contact pressure between the plug contacts 16 and the sled contacts 40.

A preferred embodiment of the invention includes a shield 60 generally disposed between the top row 46 and bottom row 48 of contacts. Depending on the width of the shield, and the number of contacts in each of the rows, the shield may or may not extend sufficiently far to be directly interposed between any possible combination of pairs of contacts, one taken from the top row and one taken from the bottom row. In some embodiments it may be preferable to have a wider shield (e.g., one that traverses the entire width of the rows of contacts) or one or more shields of a narrower width (e.g., disposed directly between only particular pairs of contacts, one taken from each row).

Figure 13:
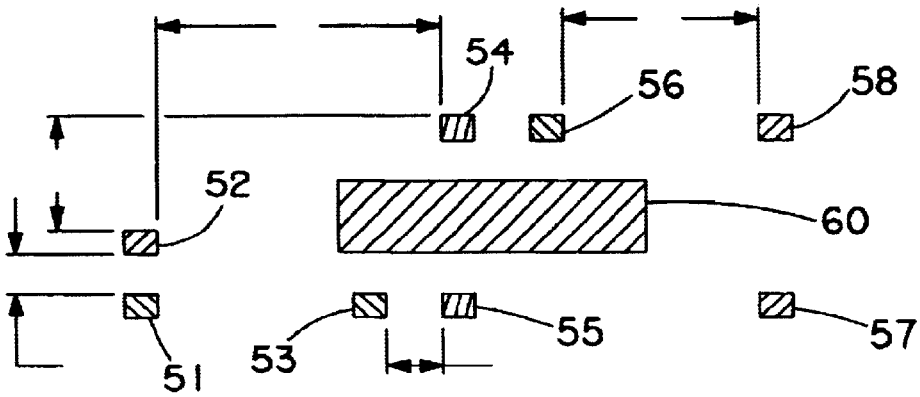
Figure 14:
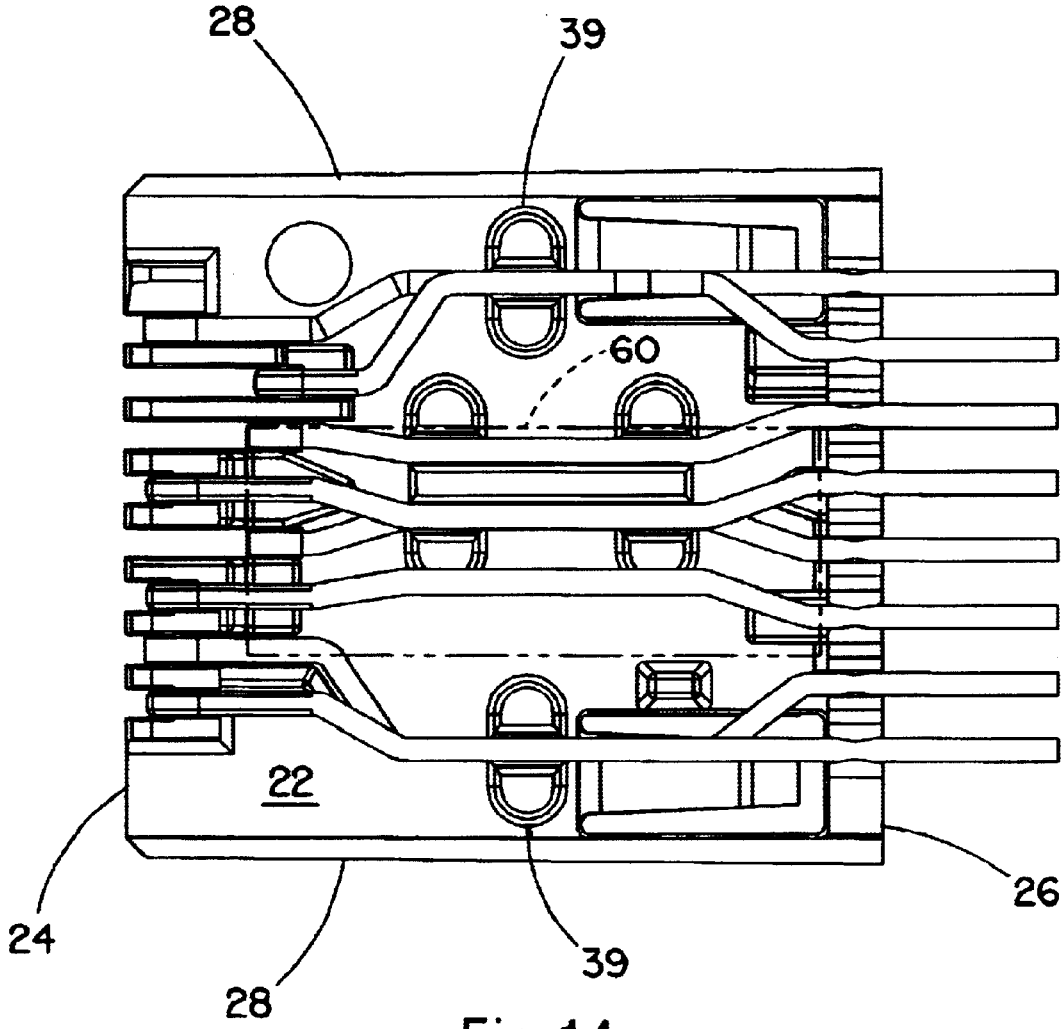
FIG. 14 shows a top plan view of the non-mating side of the sled in accordance with a preferred embodiment of the invention, where the contacts are shown installed and the location of the shield relative thereto is shown in hidden lines.

In the shown embodiment, there are four contacts in each of the top and bottom rows, 46 and 48, respectively, and the shield 60 is directly interposed only between the more central contacts in each row. For example, as seen in FIGS. 10–13, the top row includes contact #2, 52; contact #4, 54; contact #6, 56; and contact #8, 58, while the bottom row includes contact #1, 51; contact #3, 53; contact #5, 55; and contact #7, 57. In the shown example, and as best seen in FIGS. 13 and 14, the shield 60 is directly disposed, for example, between contact #4, 54 and contact #3, 53. Similarly, it is directly disposed between contact #6, 56 and contact #5, 55. The shield 60 is not, however, disposed directly between contact #8, 58 and contact #7, 57, because it does not extend far enough laterally. Thus, within the scope of the invention, one can selectively shield particular contacts in the top row 46 from particularly contacts in the bottom row 48, without necessarily shielding all contacts in one row from all contacts in the other row. Such flexibility is important in manipulating the electrical properties of the connector to comply with various predefined standards. Especially when this flexibility is combined with advantages that can be gained by diverting portions of the contacts on the compensating (non-mating) side of the sled (as discussed below), significant benefits can be achieved. As stated above, the sled may preferably include structures 38 to facilitate the assembly and retention of the shield 60 to the sled 10.

As indicated above, it is an objective of such jacks, and connectors generally, to facilitate higher speed transmissions with increasingly less signal degradation due to transient electrical properties at the connector, such as inductance, capacitance, and crosstalk. The industry, for example, has established standards such as "Category 5" and "Category 6" that connectors can meet or fail to meet based on the various levels of inductance, capacitance, and crosstalk occurring across those connectors. In particular, with an eight-contact arrangement generally configured and enumerated comparably to the one in the shown embodiment, it is important that both the near-end crosstalk (NEXT) and the far-end crosstalk (FEXT) are maintained below or within a particular range with regard to particular pairs of contacts within the system. In particular, a NEXT/FEXT comparison is considered, for example, with regard to connector pairs

4,5-1,2. In order to improve the electrical performance of this jack with regard to that particular comparison, the intermediate portion 42 of contact #2, 52 has been lowered, in part, out of the plane of the top row 46 of contacts and toward the bottom row 48 of contacts. By moving the intermediate portion closer to contact #5, 55, and further from contact #4, 54 the 4,5-1,2 NEXT/FEXT comparison is improved. Although not shown in the figures, similar benefits might, for example, be obtained by lowering contact #8, 58 out of the plane of the top row 46 toward the bottom row, whether in addition to lowering contact #2 or instead of lowering contact #2.

Another NEXT/FEXT comparison that is generally performed to determine Category 6, compliance, for example, is the 4,5-3,6 NEXT/FEXT comparison. That is, the near and far-end crosstalks between these respective pairs of contacts must be within or lower than a specified range in order for the connector to meet Category 6 standards. Relative to previous designs, contact #3, 53 has been moved further away from contact #5, 55 and contact #6, 56 has been moved further away from contact #4, 54, in the opposite direction from contact #3, 53. These relative moves result in a better electrical performance.

It should be noted that the above-described inventions contemplate many embodiments not specifically described, and the explicitly described and shown embodiments should be considered to be exemplary rather than definitional. As examples of alternatives not specifically described, for example, and without limitation or exclusion, the sled may have more than or fewer than the eight contacts shown in the figures, or the single shield shown in the figures could be replaced by multiple shields strategically placed to further enhance the electrical properties of the jack. The inventions are defined by the following claims.

We claim:

1. A jack in a telecommunications system for receiving a plug therein, said jack comprising:

a housing having an aperture for receiving said plug;

a sled having a mating side and a non-mating side, said mating side generally disposed to be accessible from said aperture by said plug;

a first plurality of contacts wrapped around said sled so as to extend from said non-mating side of said sled to said mating side of said sled, said first plurality of contacts being accessible by said plug on said mating side of said sled when said plug is inserted into said aperture;

a second plurality of contacts wrapped around said sled so as to extend from said non-mating side of said sled to said mating side of said sled, said second plurality of contacts being accessible by said plug on said mating side of said sled when said plug is inserted into said aperture; and shield disposed generally between said first plurality of contacts and said second plurality of contacts on said non-mating side of said sled.

2. A jack in accordance with claim 1 wherein each of said first and second pluralities of contacts includes at least two contacts.

3. A jack in accordance with claim 2 wherein said first plurality of contacts includes contact numbers 2, 4, 6, and 8 and said second plurality of contacts includes contact numbers 1, 3, 5, and 7, and wherein said shield is disposed directly between contact numbers 4 and 3 and also directly between contact numbers 6 and 5.

4. A jack in accordance with claim 2 wherein each of said first and second pluralities of contacts includes at least four contacts.

5. A jack in accordance with claim 4 wherein said shield is disposed directly between at least one of said first plurality of contacts and at least one of said second plurality of contacts.

6. A jack in accordance with claim 4 wherein said shield is disposed directly between every combination of two contacts wherein one of said contacts is chosen from said first plurality of contacts and one of said contacts is chosen from said second plurality of contacts.

7. A jack in a telecommunications system for receiving a plug therein, said jack comprising:

a housing having an aperture for receiving said plug;

a sled having a mating side and a non-mating side, said mating side generally disposed to be accessible from said aperture by said plug;

a first plurality of contacts wrapped around said sled so as to extend from said non-mating side of said sled to said mating side of said sled, wherein said first plurality of contacts are accessible by said plug on said mating side of said sled when said plug is inserted into said aperture and wherein said first plurality of contacts generally are disposed in a first common plane on said non-mating side of said sled;

a second plurality of contacts wrapped around said sled so as to extend from said non-mating side of said sled to said mating side of said sled, wherein said second plurality of contacts are accessible by said plug on said mating side of said sled when said plug is inserted into said aperture and wherein said second plurality of contacts generally are disposed in a second common plane on said non-mating side of said sled, said second common plane being distinct from said first common plane of said first plurality of contacts; and wherein at least one of said contacts from said first plurality contacts includes an intermediate portion on said non-mating side of said sled wherein said intermediate portion is bent substantially out of said first common plane in the direction of at least one of said second plurality of contacts to enhance the electrical performance of said jack.

8. A jack in accordance with claim 7 wherein said first and second pluralities of contacts each include four contacts, said first plurality of contacts including contact numbers 2, 4, 6, and 8, and said second plurality of contacts including contact numbers 1, 3, 5, and 7.

9. A jack in accordance with claim 8 wherein contact number 2 includes an intermediate portion bent in the direction of said second common plane and wherein said intermediate portion of contact number 2 is closer to said second common plane than it is to said first common plane.

10. A jack in accordance with claim 8 wherein contact number 2 includes an intermediate portion bent substantially out of said first common plane and wherein the distance between said intermediate, portion of contact number 2 and contact number 5 is less than the distance between said intermediate portion of contact number 2 and contact number 4.

11. A jack in accordance with claim 8 wherein contact number 8 includes an intermediate portion bent in the direction of said second common plane and wherein said intermediate portion of contact number 8 is closer to said second common plane than it is to said first common plane.

12. A jack in accordance with claim 7 further including a shield disposed generally between said first plurality of contacts and said second plurality of contacts on said non-mating side of said sled.

13. A jack in accordance with claim 12 wherein said first plurality of contacts includes contact numbers 2, 4, 6, and 8 and said second plurality of contacts includes contact numbers 1, 3, 5, and 7, and wherein said shield is disposed directly between contact numbers 4 and 3 and also directly between contact numbers 6 and 5.

14. A jack in accordance with claim 12 wherein said intermediate portion is generally disposed on the same side of said shield as said second plurality of contacts.

15. A jack in accordance with claim 12 wherein said shield is not disposed directly between said intermediate portion of contact number 2 and any of said second plurality of contacts.

16. A telecommunications system having a plurality of jacks for receiving plugs therein, each of said jacks comprising:

a housing having an aperture for receiving one of said plugs;

a sled having a mating side and a non-mating side, said mating side generally disposed to be accessible from said aperture by one of said plugs;

a first plurality of contacts wrapped around said sled so as to extend from said non-mating side of said sled to said mating side of said sled, said first plurality of contacts being accessible by one of said plugs on said mating side of said sled when said plug is inserted into said aperture;

a second plurality of contacts wrapped around said sled so as to extend from said non-mating side of said sled to said mating side of said sled, said second plurality of contacts being accessible by one of said plugs on said mating side of said sled when said plug is inserted into said aperture; and a shield generally disposed between said first plurality of contacts and said second plurality of contacts on said non-mating side of said sled.

17. A telecommunications system in accordance with claim 16 wherein each of said first and second pluralities of contacts includes at least two contacts.

18. A telecommunications system in accordance with claim 17 wherein said first plurality of contacts includes contact numbers 2, 4, 6, and 8 and said second plurality of contacts includes contact numbers 1, 3, 5, and 7, and wherein said shield is disposed directly between contact numbers 4 and 3 and also directly between contact numbers 6 and 5.

19. A telecommunications system in accordance with claim 17 wherein each of said first and second pluralities of contacts includes at least four contacts.

20. A telecommunications system in accordance with claim 19 wherein said shield is disposed directly between at least one of said first plurality of contacts and at least one of said second plurality of contacts.

21. A telecommunications system in accordance with claim 19 wherein said shield is disposed directly between every combination of two contacts wherein one of said contacts is chosen from said first plurality of contacts and one of said contacts is chosen from said second plurality of contacts.

* * * * *

UNITED STATES PATENT AND TRADEMARK OFFICE

CERTIFICATE OF CORRECTION

PATENT NO. : 6,695,649 B1
DATED : February 24, 2004
INVENTOR(S) : Andrew Ciezak et al.

It is certified that error appears in the above-identified patent and that said Letters Patent is hereby corrected as shown below:

Column 1,
Line 7, -- increasing -- should be inserted after "handling".

Column 2,
Line 20, "floating" should be deleted.
Line 28, "Housing" should read -- housing --.

Column 4,
Line 40, "particularly" should read -- particular --.

Column 5,
Line 53, -- a -- should be inserted at the beginning of the line.

Signed and Sealed this

Tenth Day of May, 2005

JON W. DUDAS
*Director of the United States Patent and Trademark Office*